US011761148B2

(12) United States Patent
Okada et al.

(10) Patent No.: US 11,761,148 B2
(45) Date of Patent: Sep. 19, 2023

(54) COMPOSITE SKIN MATERIAL FOR VEHICLE AND METHOD FOR MANUFACTURING THE SAME

(71) Applicants: OKAMOTO INDUSTRIES, INC., Tokyo (JP); HONDA MOTOR CO., LTD., Tokyo (JP)

(72) Inventors: Shinya Okada, Tokyo (JP); Masao Suzuki, Shizuoka (JP); Shin Nakaya, Shizuoka (JP); Tomoyuki Uemura, Tokyo (JP)

(73) Assignees: OKAMOTO INDUSTRIES, INC., Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/407,436

(22) Filed: Aug. 20, 2021

(65) Prior Publication Data

US 2022/0056637 A1 Feb. 24, 2022

(30) Foreign Application Priority Data

Aug. 24, 2020 (JP) ..... JP2020-141032

(51) Int. Cl.
*D06N 3/00* (2006.01)
*D06N 3/14* (2006.01)

(52) U.S. Cl.
CPC ..... *D06N 3/0009* (2013.01); *D06N 3/007* (2013.01); *D06N 3/14* (2013.01); *D06N 2203/068* (2013.01); *D06N 2209/121* (2013.01); *D06N 2211/28* (2013.01)

(58) Field of Classification Search
None
See application file for complete search history.

(56) References Cited

U.S. PATENT DOCUMENTS

2017/0266913 A1 9/2017 Kaneko et al.
2021/0040683 A1* 2/2021 Wanibuchi ..... D06N 7/00

FOREIGN PATENT DOCUMENTS

JP 2006188773 A 7/2006
JP 2017165209 A 9/2017

OTHER PUBLICATIONS https://patents.google.com/patent/CN111372765B/en?oq=20210040683 (Year: 2020).*
English Abstract of JP2017165209, Publication Date: Sep. 21, 2017.
Office Action in corresponding Japanese Patent Application No. 2020-141032 (pp. 1-4) and English machine translation thereof (pp. 1-4).

* cited by examiner

*Primary Examiner* — Arti Singh-Pandey
(74) *Attorney, Agent, or Firm* — MILLEN, WHITE, ZELANO AND BRANIGAN, P.C.; Harry B. Shubin

(57) ABSTRACT

A composite skin material for a vehicle wherein a synthetic leather includes a surface resin layer having a plurality of openings, an adhesion layer present on the rear surface of the surface resin layer, and a fibrous base material present on the rear surface of the surface resin layer across the adhesion layer, and the adhesion layer is present only at the adherend part, except for the plurality of openings, in the rear surface of the surface resin layer, and the base material surface of the fibrous base material is bonded to the surface resin layer.

6 Claims, 3 Drawing Sheets

COMPOSITE SKIN MATERIAL FOR VEHICLE AND METHOD FOR MANUFACTURING THE SAME

BACKGROUND OF THE INVENTION

1. Field of the Invention

The present invention relates to a composite skin material for a vehicle, having a synthetic leather for use on the surface side of a seat suitable for a vehicle as a vehicle interior finishing material, and a method for manufacturing a composite skin material for a vehicle.

2. Description of the Related Art

Conventionally, as this type of composite skin material for a vehicle, there is a skin material in which a polyurethane resin layer is provided on the front surface side of a fibrous base material, the fibrous base material and the polyurethane resin layer form a synthetic leather, a plurality of openings are provided penetrating through the fibrous base material from the front surface of the polyurethane resin layer, and a woven fabric is bonded to the rear surface side of the fibrous base material via an adhesive layer, thereby integrating the synthetic leather and the woven fabric in a composite form.

As the fibrous base material, a woven fabric, a knitted material, a nonwoven fabric, or the like is appropriately selected according to the use, and for the material for the fiber forming the fibrous base material, a synthetic fiber (polyester) is preferably used.

The polyurethan resin layer includes a skin resin layer (skin layer) formed of a polyurethan resin and an adhesion resin layer (adhesion layer) using an adhesive of a polyurethan resin. The skin resin layer is stacked on the fibrous base material via the adhesion resin layer.

SUMMARY OF THE INVENTION

Incidentally, the synthetic leather to be used for a seat of a vehicle is required not only to have a strength such as a tear strength enough to prevent a problem when used as a vehicle interior finishing material, but also to have an air permeability enough to prevent steaminess or stickiness from being caused due to perspiration during sitting for a long time.

However, conventionally, a plurality of openings are formed through the whole synthetic leather including the fibrous base material to enhance the air permeability. For this reason, the overall strength of the fibrous base material is reduced. In order to solve reliably the problem of steaminess or stickiness due to perspiration during sitting for a long time, a large number of openings are required to be formed perforating in the entire surface of the fibrous base material. This undesirably results in a problem that the strength necessary for the vehicle interior finishing material use cannot be obtained.

Particularly, a synthetic leather, in which fibrous base materials such as a woven fabric and a knitted material are stacked, is formed with a plurality of openings puncturing therethrough. As a result, the fiber of the fibrous base material is ruptured at the plurality of openings. For this reason, the fiber is loose due to the friction of the fibrous base material and the like in associated with use. As a result, undesirably, not only the strength is reduced and the durability is deteriorated, but also the loosen fiber is visible through the plurality of openings, which deteriorates the exterior appearance.

Under such circumstances, it can be considered that the reduction of the strength of the fibrous base material is compensated for by a reinforcing material or the like. However, in this case, the fibrous base material is hardened overall. For this reason, favorable textures of a synthetic leather is damaged, undesirably resulting in the deterioration of the commercial value.

Further, when a cushion material such as urethane foam is provided on the rear side of the fibrous base material, the cushion material such as urethane foam is visible through the fibrous base material by the plurality of openings, or may slip therethrough.

In order to resolve such a problem, a composite skin material for a vehicle in accordance with the present invention includes at least the configurations in accordance with the following independent claims.

A composite skin material for a vehicle, having a synthetic leather to be used on a front surface side of a seat, the synthetic leather including a surface resin layer having a plurality of openings, an adhesion layer formed on a rear surface of the surface resin layer, and a fibrous base material formed on the rear surface of the surface resin layer across the adhesion layer, wherein the adhesion layer is present only at an adherend part, except for the plurality of openings, in the rear surface of the surface resin layer, and a base material surface of the fibrous base material is bonded to the surface resin layer.

A method for manufacturing a composite skin material for a vehicle, having a synthetic leather to be used on a front surface side of a seat, the method including:

a sheet forming step of forming a surface resin layer of the synthetic leather, a punching step of forming a plurality of openings in the surface resin layer, a pasting step of forming an adhesion layer on a rear surface of the surface resin layer having the plurality of openings, and a sticking step of bonding a fibrous base material to the rear surface of the surface resin layer across the adhesion layer, wherein in the pasting step, the adhesion layer is partially formed only at an adherend part, except for the plurality of openings, in the rear surface of the surface resin layer.

DESCRIPTION OF THE PREFERRED EMBODIMENTS

Hereinafter, the embodiments of the present invention will be described in detail with reference to the accompanying drawings.

A composite skin material for vehicle A in accordance with an embodiment of the present invention is used on the front surface side of the seat suitable for a vehicle as a vehicle interior finishing material, and is a skin material integrated in a composite form having a synthetic leather (synthetic resin leather) L, and having a woven fabric F, a cushion material (not shown), or the like provided on the rear surface side of the synthetic leather L according to the use thereof.

Figure 1:
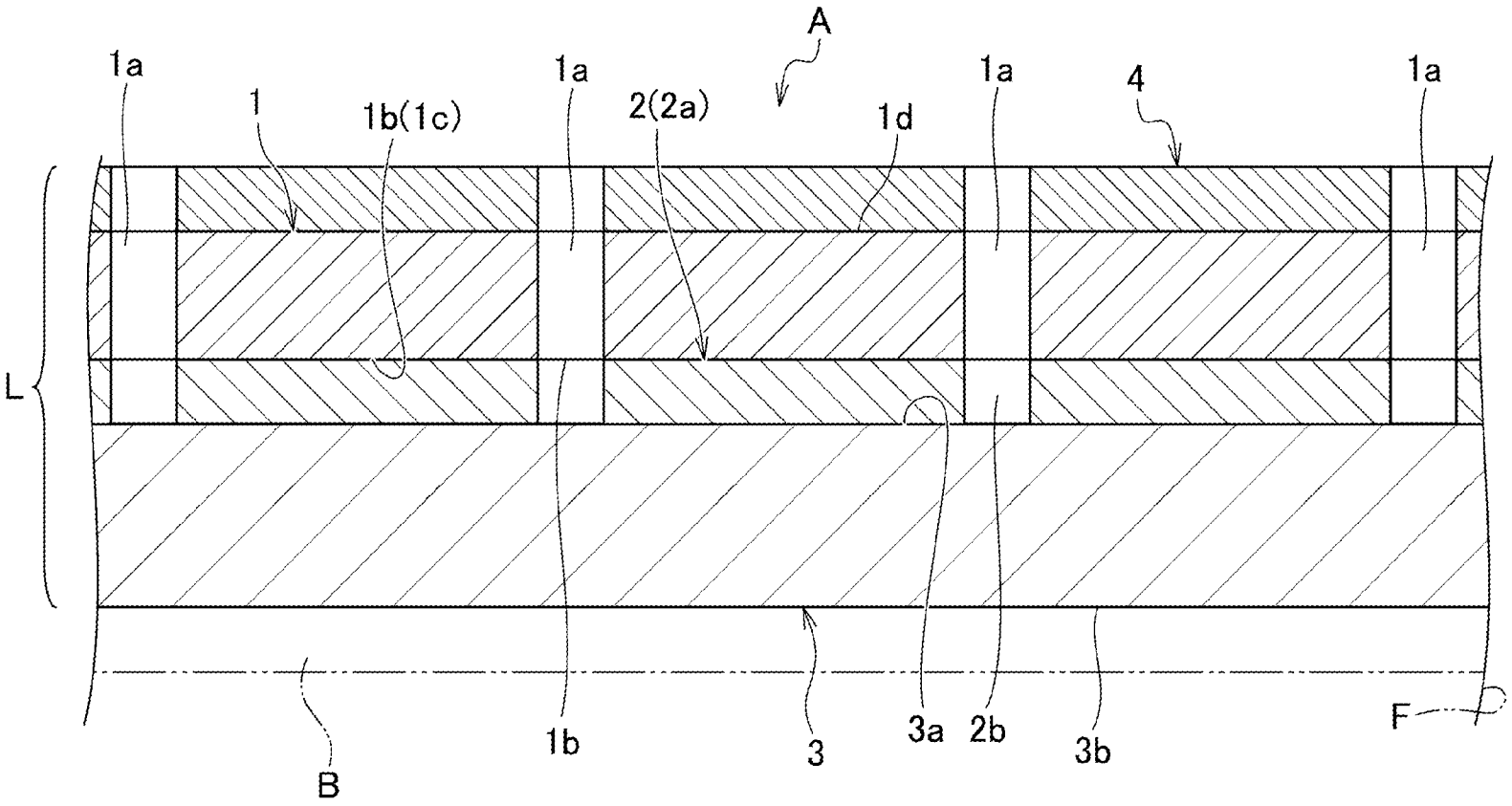
FIG. 1 is an explanatory view showing the overall configuration of a composite skin material for a vehicle in accordance with an embodiment of the present invention, and a longitudinal front view of a synthetic leather on a partially enlarged scale.
Figure 2:
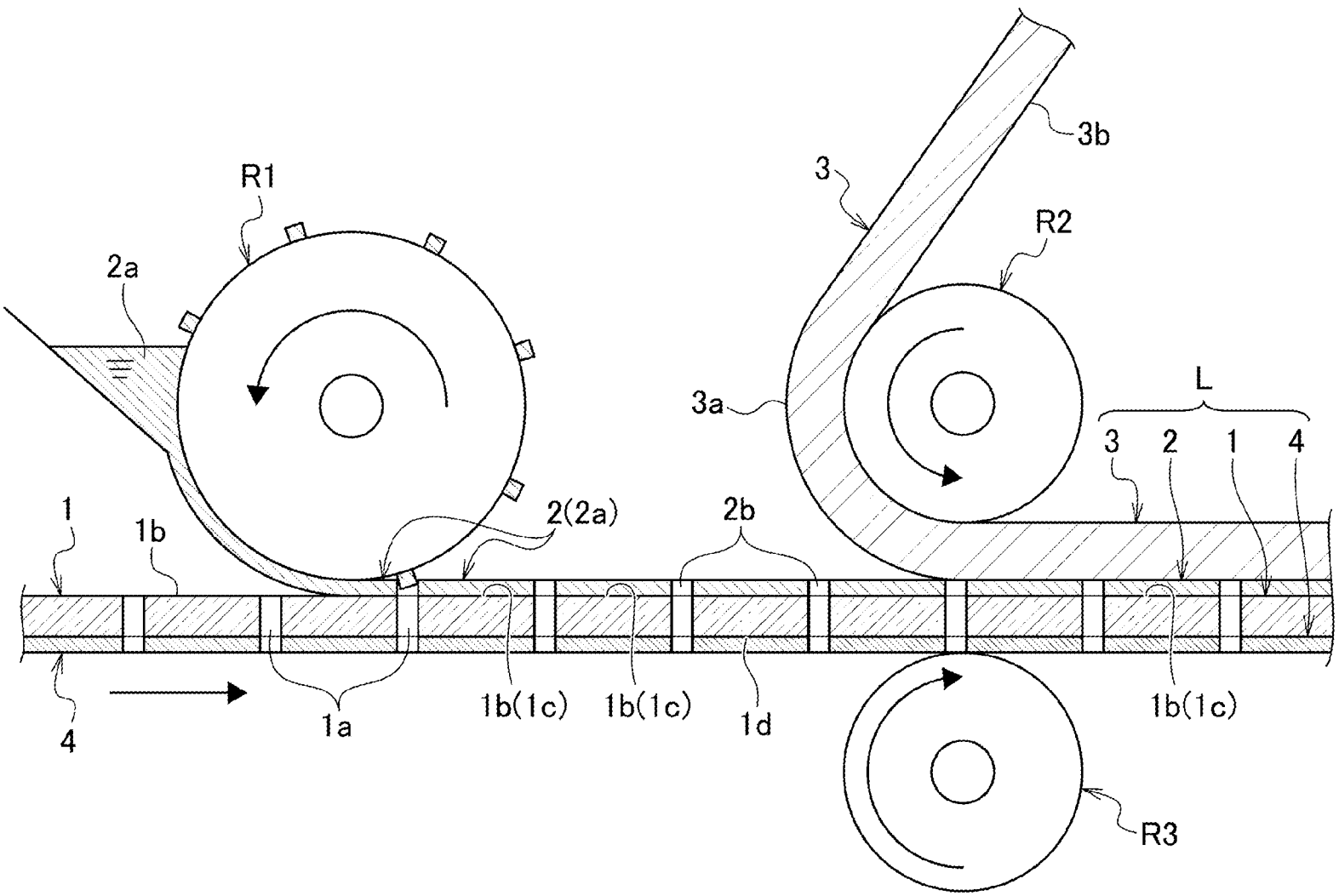
FIG. 2 is a longitudinal front view showing the manufacturing step of the composite skin material for a vehicle.

Particularly, the synthetic leather L of the composite skin material for a vehicle A in accordance with an embodiment of the present invention includes a surface resin layer 1, an adhesion layer 2 formed on the rear surface 1*b* of the surface resin layer 1, and a fibrous base material 3 formed on the rear surface 1*b* of the surface resin layer 1 with the adhesion layer 2 interposed therebetween as main constituent elements as shown in FIGS. 1 and 2.

Further, a surface treated layer 4 is preferably included on the front surface side of the surface resin layer 1.

The surface resin layer 1 is a material including a polyurethane resin such as thermoplastic polyurethane (TPU), polyvinyl chloride (PVC: polyvinyl chloride), or a synthetic resin similar thereto as a main component, and is appropriately formed in a film shape with a thickness of (0.10 to 1.00 mm, and particularly, 0.20 to 0.80 mm).

The main component forming the surface resin layer 1 may contain conventionally known additives such as a colorant, a plasticizer, a stabilizer, a filler, a lubricant, a paint, a blowing agent, and a mold release agent, if required. These may be used singly alone, or in combination of two or more thereof.

Further, the surface resin layer 1 has a plurality of openings 1*a*. The plurality of openings 1*a* are perforated at prescribed intervals by perforating the surface resin layer 1 by a punching machine. The arrangement of the plurality of openings 1*a* includes a lattice arrangement, a staggered arrangement, or the like. The pore size of the plurality of openings 1*a* is an average of about 0.8 to 3.0 mm, and is set at a prescribed porosity (about 3% to 20%).

The adhesion layer 2 is partially formed by applying an adhesive 2*a* only on the adherend part 1*c* except for the plurality of openings 1*a* in the rear surface 1*b* of the surface resin layer 1.

As the adhesive 2*a* of the adhesion layer 2, a hot melt type including a polyurethane resin having high affinity with the main component of the surface resin layer 1 is preferably used. Particularly, a reactive hot melt adhesive capable of adjusting the viscosity by the heating temperature relatively easily is preferably used.

The method for applying the adhesive 2*a* is preferably performed by partially transferring the adhesive 2*a* along a part of the rear surface 1*b* of the surface resin layer 1, particularly, only the adherend part 1*c* except for the plurality of the openings 1*a* with printing or the like.

The printing methods suitable for partial transfer of the adhesive 2*a* includes intaglio printing such as gravure printing shown in FIG. 2.

In the example shown, the adhesive 2*a* supplied to the print surface of a transfer roll R1 is brought into contact with the rear surface 1*b* of the surface resin layer 1. As a result, the adhesive 2*a* is transferred onto only the adherend part 1*c* except for the plurality of openings 1*a*. It is configured such that the adhesive 2*a* at the parts opposed to the plurality of openings 1*a* are in non-contact with the rear surface 1*b* of the surface resin layer 1, and hence is not transferred, and is left on the print surface of the transfer roll R1. For this reason, the parts opposed to the plurality of openings 1*a* of the adhesion layer 2 become through parts 2*b*.

Further, although not shown as other printing methods, other transfer structures than the example shown may be used, and intaglio printing can be changed to plate type (printing) such as letterpress printing or planography, non-plate type (printing) such as ink jet printing.

Incidentally, the viscosity and the coating amount (coating thickness) of the adhesive 2*a* affect the practicability of transfer, the flowability after transfer, and the sufficient bond strength with a fibrous base material 3 described later, and hence are required to be set within a prescribed range.

Experimentally, when the viscosity of the adhesive 2*a* is too low, for example, as low as 1000 mPa·s or less, the adhesive 2*a* transferred only on the adherend part 1*c* may flow until hardening and fixing, to block the plurality of openings 1*a*, which may hinder the air permeability. In contrast, when the viscosity of the adhesive 2*a* is too high, for example, as high as 30000 mPa·s or more, transfer of the adhesive 2*a* onto the rear surface 1*b* of the surface resin layer 1 becomes difficult. Further, even when transfer of the adhesive 2*a* is performed forcedly, the adhesive 2*a* is transferred in a film form, and may block the plurality of openings 1*a*, thereby hindering the air permeability.

When the coating thickness of the adhesive 2*a* is too small, for example, as small as less than 15 μm, a sufficient bond strength with the fibrous base material 3 described later cannot be obtained. In contrast, when the coating amount of the adhesive 2*a* is too large as large as 100 μm or more, the adhesive 2*a* after transfer flows until fixing, and may block the plurality of openings 1*a*.

Thus, the viscosity of the adhesive 2*a* is preferably set at more than 1000 mPa·s and less than 30000 mPa·s, and particularly 5000 to 25000 mPa·s. The coating thickness of the adhesive 2*a* is preferably set at 15 μm or more and less than 100 μm, and particularly 30 to 80 μm.

The fibrous base material 3 includes a knitted material, a woven fabric, a nonwoven fabric, or the like using polyethylene terephthalate (PET), polytrimethylene terephthalate (PTT), or other polyesters, or synthetic fibers, natural fibers, regenerated fibers, semi-synthetic fibers, or the like similar thereto singly alone or in combination of two or more thereof, and formed in a structure having air permeability. The fibrous base material 3 is not perforated with a plurality of openings 1*a*, and the synthetic fiber will not be ruptured due to the perforation.

As the fibrous base material 3, a solid knitted material is preferably used. A solid knitted material has a three-layered stereoscopic structure (three-dimensional solid knitted material) obtained by knitting the base fabrics (knitted fabrics) on both the front and rear surfaces with connecting yarns such as monofilaments. For this reason, when a solid knitted material is used as the fibrous base material 3, the change in size of the mesh of the base fabrics enables the proper air permeability of the fibrous base material 3 to be kept.

In the fibrous base material 3, the base material surface 3*a* opposed to the adhesion layer 2 is bonded with the adhesive 2*a* formed at a part (adherend part 1*c*) of the rear surface 1*b* of the surface resin layer 1 as shown in FIGS. 1 and 2.

In the example shown, the surface resin layer 1 and the fibrous base material 3 are sandwiched between a pair of pressure rolls R2 and R3 for pressurization. As a result, the base material surface 3*a* of the surface resin layer 1 is brought into pressure contact with the rear surface 1*b* of the surface resin layer 1, so that both are joined and stacked one on another.

A surface treated layer 4 is formed with a prescribed thickness along the front surface 1*d* of the surface resin layer 1.

With the surface treated layer 4, the gloss adjustment treatment using a matting agent, a glazing agent, or the like, the treatment for forming a protective film on the front surface, or the like may be implemented. As the method for forming the surface treated layer 4, mention may be made of printing or coating of a surface treating agent, or the like. Gravure printing, printing using a printer such as an ink jet printer, or coating using spray coat by a spray gun is preferable.

Further, the surface treated layer 4 is subjected to embossing for making a prescribed uneven pattern such as an emboss pattern.

As the woven fabric F to be joined to the rear surface side of the synthetic leather L, the plain fabrics described in Japanese Patent Application Publication No. 2017-165209, or the like is used.

In the case of the example shown, an adhesive B including a reactive hot melt polyurethane resin or the like is coated on the base material rear surface 3*b* of the fibrous base material 3 to be formed, followed by pressure contact with the woven fabric F. As a result, both are joined and stacked one on another.

Further, although not shown as other examples, a change such as the arrangement of a cushion material such as urethan foam in place of the woven fabric F according to the use of the synthetic leather L is also possible.

Figure 3:
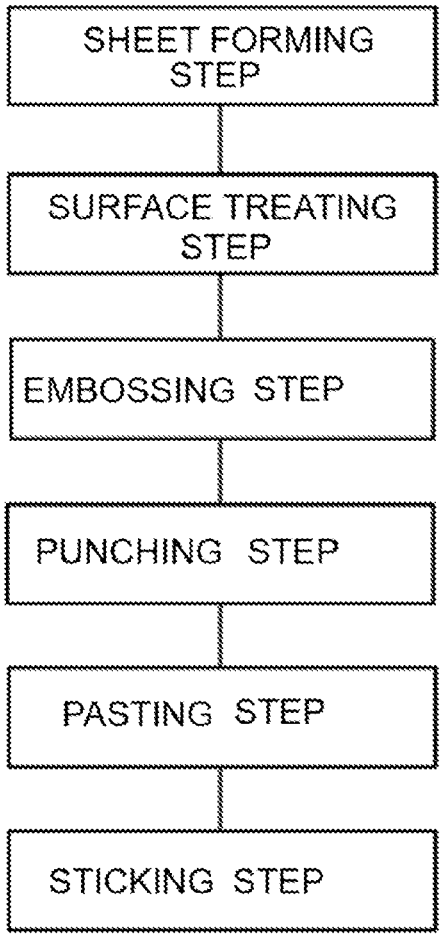
FIG. 3 is a flowchart showing a method for manufacturing a composite skin material for a vehicle in accordance with an embodiment of the present invention.

Then, the method for producing the synthetic leather L in the method for manufacturing the composite skin material for vehicle A in accordance with an embodiment of the present invention includes a sheet forming step, a punching step, a pasting step, and a sticking step as main steps as in the flowchart shown in FIG. 3.

Further, a surface treating step and an embossing step are preferably included between the sheet forming step and the punching step.

In the sheet forming step, the surface resin layer 1 of the synthetic leather L or the like is formed by a roll forming machine or the like.

In the surface treating step, a necessary surface treatment such as formation of the surface treated layer 4 on the front surface side of the surface resin layer 1 is performed.

In the embossing step, necessary embossing stepping such as drawing of a prescribed uneven pattern such as an emboss pattern on the surface treated layer 4 is performed.

In the punching step, the surface resin layer 1 and the surface treated layer 4 are subjected to perforation of a plurality of openings 1*a* by a punching machine or the like.

In the pasting step, with respect to the rear surface 1*b* of the surface resin layer 1 perforated with the plurality of openings 1*a*, the adhesive 2*a* is transferred onto only the adherend part 1*c* except for the plurality of openings 1*a* by printing or the like, so that the adhesion layer 2 is partially formed.

In the sticking step, the fibrous base material 3 having air permeability is bonded to the rear surface 1*b* of the surface resin layer 1 with the adhesion layer 2 interposed therebetween.

With such a composite skin material for vehicle A and the manufacturing method thereof in accordance with an embodiment of the present invention, the adhesion layer 2 is formed only at the adherend part 1*c* except for the plurality of openings 1*a* in the rear surface 1*b* of the surface resin layer 1 having the plurality of openings 1*a*. As a result, the rear surface 1*b* of the surface resin layer 1 is bonded and joined to the base material surface 3*a* of the fibrous base material 3 without blocking the plurality of openings 1*a* by the adhesion layer 2.

For this reason, in the bonded state in which the fibrous base material 3 is bonded to the surface resin layer 1 with the adhesion layer 2 interposed therebetween, the air permeability is ensured through the plurality of openings 1*a* included in the surface resin layer 1, the through parts 2*b* of the adhesion layer 2, and the internal space of the fibrous base material 3.

Therefore, it is possible to obtain sufficient air permeability and sufficient strength without perforating the fibrous base material 3.

As a result, as compared with the conventional one requiring perforation of the fibrous base material 3, even when the number of the openings 1*a* is increased in order to enhance the air permeability, the strength necessary for vehicle interior finishing material use can be obtained without the reduction of the overall strength of fibrous base material 3.

Further, the fiber of the fibrous base material 3 is not ruptured by perforation. For this reason, the fiber is not loosened due to the friction of the fibrous base material 3 associated with use, or the like, so that the durability is improved, resulting in an improvement of the commercial value. In addition, the deterioration of the outer appearance that the fiber of the fibrous base material 3 can be seen through the plurality of openings 1*a* can also be prevented.

Further, even when the porosity of the surface resin layer 1 changes, the change in strength as the synthetic leather L is small. For this reason, the fiber is also adaptable to the designs of a large variety of patterns.

Particularly, the fibrous base material 3 is preferably a sold knitted material.

In this case, for the solid knitted material (three-dimensional solid knitted material) to be the fibrous base material 3, the size of the mesh of the base fabric serving as both the front and rear surfaces is changed, thereby keeping the proper air permeability.

Therefore, the steaminess can be reduced, thereby obtaining comfortable sitting feeling.

As a result, even when a passenger is seated over a long time, it is possible to prevent steaminess or stickiness due to perspiration.

Further, the adhesion layer 2 preferably partially has the adhesive 2*a* only at the adherend part 1*c* of the rear surface 1*b* of the surface resin layer 1 by printing.

In this case, it becomes possible to coat the adhesive 2*a* only onto the adherend part 1*c* except for the plurality of openings 1*a* in the rear surface 1*b* of the surface resin layer 1 having the plurality of openings 1*a* with ease and rapidly, and with precision.

Therefore, it is possible to prevent the penetration of the adhesive 2*a* into the plurality of openings 1*a*.

As a result, the plurality of openings 1*a* are not blocked by penetration of the adhesive 2*a*, so that sufficient air permeability can be ensured with reliability. Further, the speed of coating of the adhesive 2*a* is increased. For this reason, mass production is possible, and the reduction of the cost can also be achieved.

Further, the viscosity of the adhesive 2*a* is preferably more than 1000 mPa·s and less than 30000 mPa·s.

In this case, the viscosity of the adhesive 2*a* is not too high as high as less than 30000 mPa·s. This enables transfer of the adhesive 2*a* onto the rear surface 1*b* of the surface resin layer 1, and causes the adhesive 2*a* to be transferred in a film form, which prevents blocking of the plurality of openings 1*a*. Further, the viscosity of the adhesive 2*a* is not too low, as low as more than 1000 mPa·s. For this reason, the adhesive 2*a* after transfer will not flow until hardening and fixing, and will not block the plurality of openings 1*a*.

Therefore, it is possible to simultaneously prevent flowing of the adhesive 2*a* after transfer due to the excessively low viscosity of the adhesive 2*a*, and the transfer inability due to the excessively high viscosity of the adhesive 2*a*.

As a result, transfer of the adhesive 2*a* can be performed under the optimum conditions, thereby suppressing the hindrance in air permeability due to flowing after transfer.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding Japanese application No. 2020-141032, filed Aug. 24, 2020, are incorporated by reference herein.

EXAMPLES

Below, examples of the present invention will be described. Examples 1 to 7 and Comparative Examples 1 to 4

Examples 1 to 7 shown in Table 1 and Comparative Examples 1 to 4 shown in Table 2 each use a synthetic leather including a surface resin layer containing TPU as a main component, and having a thickness of 0.23 mm, an adhesion layer formed by partially coating a reactive hot melt type adhesive, and a fibrous base material including a solid knitted material made of PET as a common configuration.

Examples 1 to 7 and Comparative Examples 1 to 4 are different from each other in any of the pore side of the plurality of openings 1*a*, the porosity of the surface resin layer 1, the viscosity of the adhesive 2*a*, and the thickness of the adhesion layer 2.

Example 1 is common to Example 4, and the like in that the viscosity of the adhesive is 9000 mPa·s, and the thickness of the adhesion layer is set at 50 μm, and is different from Examples 4 and the like in that the pore size of the plurality of openings is set at 1.1 mm, and the porosity of the surface resin layer is set at 7.6%.

Example 2 is common to Example 4, and the like in that the viscosity of the adhesive is 9000 mPa·s, and the thickness of the adhesion layer is set at 50 μm, and is different from Examples 4 and the like in that the pore size of the plurality of openings is set at 1.5 mm, and the porosity of the surface resin layer is set at 11.0%.

Example 3 is common to Examples 1, 4, and the like in that the thickness of the adhesion layer is set at 50 μm, and is different from Examples 1 in that the pore size of the plurality of openings is set at 1.0 mm, the porosity of the surface resin layer is set at 12.8%, and the viscosity of the adhesive is set at 5000 mPa·s.

Example 4 is different from Example 3 only in that the viscosity of the adhesive is set at 9000 mPa·s, and is common to Example 3 in other respects.

Example 5 is different from Examples 3 and 4 only in that the viscosity of the adhesive is set at 25000 mPa·s, and is common to Examples 3 and 4 in other respects.

Example 6 is different from Example 4 only in that the thickness of the adhesion layer is set at 15 μm, and is common to Example 4 in other respects.

Example 7 is different from Examples 4 and 6 only in that the thickness of the adhesion layer is set at 90 μm, and is common to Examples 4 and 6 in other respects.

Comparative Example 1 is different from Examples 4, 6, and 7 only in that the thickness of the adhesion layer is set at 13 μm, and is common to Examples 4, 6, and 7 in other respects.

Comparative Example 2 is different from Examples 4, 6, and 7 only in that the thickness of the adhesion layer is set at 100 μm, and is common to Examples 4, 6, and 7 in other respects.

Comparative Example 3 is different from Examples 3 to 5 only in that the viscosity of the adhesive is set at 1000 mPa·s, and is common to Examples 3 to 5 in other respects.

Comparative Example 4 is different from Examples 3 to 5 only in that the viscosity of the adhesive is set at 30000 mPa·s, and is common to Examples 3 to 5 in other respects.

The evaluation results (the tensile strength of the synthetic leather, the tensile elongation of the synthetic leather, the adhesion strength of the synthetic leather, the air permeability of the synthetic leather, and the comprehensive evaluation) shown in Tables 1 and 2 are based on the following indices.

For the "tensile strength of the synthetic leather", specimens with the same size were collected from Examples 1 to 7 and Comparative Examples 1 to 4, and were subjected to respective tensile tests under the same conditions by means of a tensile tester, thereby measuring the tensile strength (N/cm) of each specimen.

For the "tensile elongation of the synthetic leather", respective tensile elongation tests were performed under the same conditions by means of a tensile tester, thereby measuring the tensile elongation (%) of each specimen.

For the "adhesion strength of the synthetic leather", specimens with the same size were collected from Examples 1 to 7 and Comparative Examples 1 to 4, and were subjected to respective peeling tests under the same conditions by means of a peeling tester, thereby measuring the adhesion strength (N/cm) of each specimen.

For the "tensile strength of the synthetic leather", specimens with the same size were collected from Examples 1 to 7 and Comparative Examples 1 to 4, and were subjected to respective air permeability tests under the same conditions by an air permeability tester, thereby measuring the air permeability (cm3/cm2·s).

For the "comprehensive evaluation", comprehensive evaluation was performed on a 3-grade scale based on the evaluation results of the "tensile strength", the "tensile elongation", the "adhesion strength", and the "air permeability".

For the evaluation results of the "comprehensive evaluation", evaluation was performed as, AA: optimum, BB: good, CC: unsuitable.

TABLE 1

| | | Example | | | | | | |
|---|---|---|---|---|---|---|---|---|
| | | 1 | 2 | 3 | 4 | 5 | 6 | 7 |
| Surface resin layer | Main material | TPU | TPU | TPU | TPU | TPU | TPU | TPU |
| | Thickness(mm) | 0.23 | 0.23 | 0.23 | 0.23 | 0.23 | 0.23 | 0.23 |
| | Pore size of opening(mm) | 1.1 | 1.5 | 1.0 | 1.0 | 1.0 | 1.0 | 1.0 |
| | Porosity(%) | 7.6 | 11.0 | 12.8 | 12.8 | 12.8 | 12.8 | 12.8 |
| Adhesive layer | Viscosity (mPa · s) | 9000 | 9000 | 5000 | 9000 | 25000 | 9000 | 9000 |
| | Thickness(μm) | 50 | 50 | 50 | 50 | 50 | 15 | 90 |
| Fibrous base material | Kind of knitted material | PET | PET | PET | PET | PET | PET | PET |
| | Material of yarn | Solid knitted material | Solid knitted material | Solid knitted material | Solid knitted material | Solid knitted material | Solid knitted material | Solid knitted material |
| Evaluation results | Tensile strength(N/cm) | 145.1/ 125.4 | 154.8/ 127.0 | 165.4/ 129.1 | 162.3/ 129.1 | 159.2/ 129.1 | 151.0/ 128.1 | 158.5/ 125.9 |
| | Tensile elongation(%) | 65/94 | 74/98 | 77/100 | 76/100 | 75/100 | 72/100 | 75/95 |
| | Adhesion strength(N/cm) | 6.5/6.2 | 6.6/6.1 | 5.3/5.1 | 6.3/6.1 | 5.5/5.2 | 5.3/5.0 | 6.6/6.3 |
| | Air permeability ($cm^3/cm^2 \cdot s$) | 41.7 | 49.2 | 32.9 | 64.7 | 67.9 | 66.4 | 21.7 |
| | Comprehensive evaluation | AA | AA | BB | AA | BB | BB | BB |

TABLE 2

| | | Comparative Example | | | |
|---|---|---|---|---|---|
| | | 1 | 2 | 3 | 4 |
| Surface resin layer | Main material | TPU | TPU | TPU | TPU |
| | Thickness (mm) | 0.23 | 0.23 | 0.23 | 0.23 |
| | Pore size of opening (mm) | 1.0 | 1.0 | 1.0 | 1.0 |
| | Porosity (%) | 12.8 | 12.8 | 12.8 | 12.8 |
| Adhesive layer | Viscosity (mPa · s) | 9000 | 9000 | 1000 | 30000 |
| | Thickness(μm) | 13 | 100 | 50 | 50 |
| Fibrous base material | Kind of knitted material | PET | PET | PET | PET |
| | Material of yarn | Solid knitted material | Solid knitted material | Solid knitted material | Solid knitted material |
| Evaluation results | Tensile strength (N/cm) | 146.2/ 123.4 | 155.2/ 128.0 | 162.3/ 127.9 | Poor transfer of adhesive |
| | Tensile elongation (%) | 66/ 97 | 76/ 97 | 78/ 99 | |
| | Adhesion strength (N/cm) | 3.1/ 2.8 | 7.0/ 6.2 | 2.8/ 2.1 | |
| | Air permeability ($cm^3/cm^2 \cdot s$) | 66.2 | 1.7 | 8.1 | |
| | Comprehensive evaluation | CC | CC | CC | CC |

Evaluation Results

Upon comparison between Examples 1 to 7 and Comparative Examples 1 to 4, favorable evaluation results are obtained Examples 1 to 7 for all the tensile strength, the tensile elongation, the adhesion strength, and the air permeability.

As apparent from the evaluation results, it has been proven that Examples 1 to 7 are composite skin materials for a vehicle, having excellent tensile strength, tensile elongation, adhesion strength, and air permeability in combination.

In contrast, Comparative Examples 1 to 4 show the evaluation results that any of the tensile strength, the tensile elongation, the adhesion strength, and the air permeability is unfavorable.

Particularly, for Comparative Example 1, the thickness of the adhesion layer was 13 μm, and the coating amount was too small, resulting in an unfavorable evaluation result in terms of the adhesion strength.

For Comparative Example 2, the thickness of the adhesion layer was 100 μm, and the coating amount was too large. For this reason, the adhesive flowed, and blocked the plurality of openings, resulting in an unfavorable evaluation result in terms of the air permeability.

For Comparative Example 3, the viscosity of the adhesive was too low, as low as 1000 mPa·s. For this reason, the adhesive flowed, and blocked the plurality of openings, resulting in an unfavorable evaluation results in terms of the air permeability and the adhesion strength.

For Comparative Example 4, the viscosity of the adhesive was too high, as high as 30000 mPa·s. For this reason, poor transfer of the adhesive onto the surface resin layer was caused, so that sticking with the fibrous base material could not be performed, resulting in an unfavorable evaluation result.

Incidentally, in the example shown in the embodiment, the surface treated layer 4 was included on the front surface of the synthetic leather L. However, the present invention is not limited thereto, and the surface treated layer 4 may not be required to be included.

Also in this case, the same advantageous effects as those of the embodiments can be obtained.

REFERENCE SIGNS LIST

A Composite skin material for a vehicle
L Synthetic leather
1 Surface resin layer
1*a* Opening
1*b* Rear surface
1*c* Adherend part
2 Adhesion layer
2*a* Adhesive
3 Fibrous base material
3*a* Base material surface The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A composite skin material for a vehicle, comprising a synthetic leather to be used on a front surface side of a seat, the synthetic leather including a surface resin layer having a plurality of openings, an adhesion layer formed on a rear surface of the surface resin layer, and a fibrous base material formed on the rear surface of the surface resin layer across the adhesion layer, wherein the adhesion layer is formed only at an adherend part, except for the plurality of openings, in the rear surface of the surface resin layer, and a base material surface of the fibrous base material is bonded to the surface resin layer, and the fibrous base material has no openings.

2. The composite skin material for a vehicle according to claim 1, wherein the fibrous base material is a three dimensional knitted material.

3. The composite skin material for a vehicle according to claim 2, wherein the adhesion layer partially has, by printing, an adhesive only at the adherend part in the rear surface of the surface resin layer.

4. The composite skin material for a vehicle according to claim 1, wherein the adhesion layer partially has, by printing, an adhesive only at the adherend part in the rear surface of the surface resin layer.

5. The composite skin material for a vehicle according to claim 4, wherein a viscosity of the adhesive is more than 1000 m·Pas and less than 30000 m·Pas.

6. A method for manufacturing a composite skin material for a vehicle according to claim 1, having a synthetic leather to be used on a front surface side of a seat, the method comprising:

a sheet forming step of forming a surface resin layer of the synthetic leather, a punching step of forming a plurality of openings in the surface resin layer, a pasting step of forming an adhesion layer along a rear surface of the surface resin layer having the plurality of openings, and a sticking step of bonding a fibrous base material to the rear surface of the surface resin layer across the adhesion layer, wherein in the pasting step, the adhesion layer is partially formed only at an adherend part, except for the plurality of openings, in the rear surface of the surface resin layer, and the fibrous base material has no openings.

* * * * *